United States Patent [19]

Schweitzer

[11] Patent Number: 4,594,875

[45] Date of Patent: Jun. 17, 1986

[54] BENDING MACHINE

[76] Inventor: Leonard J. Schweitzer, 3272 Susileen Dr., Reno, Nev. 89509

[21] Appl. No.: 652,771

[22] Filed: Sep. 19, 1984

[51] Int. Cl.[4] ..... B21D 7/00

[52] U.S. Cl. ..... 72/389; 72/213; 72/308

[58] Field of Search ..... 72/212, 213, 308, 384, 72/389, 477, 478; 74/106

[56] References Cited

U.S. PATENT DOCUMENTS 1,664,138 3/1928 Sundgren ..... 72/457

3,912,251 10/1975 Fraser et al. ..... 72/106

3,918,286 11/1975 Whitehead ..... 72/389

4,304,117 12/1981 Rawson ..... 72/457

*Primary Examiner*—Francis S. Husar

*Assistant Examiner*—Jorji M. Griffin

*Attorney, Agent, or Firm*—Townsend and Townsend

[57] ABSTRACT

A device for bending a metal bar especially suitable for bending metal bars used in reinforcing concrete structures. The device is hand operated and portable and includes a slide for bending the bars in a single horizontal plane which allows multiple, closely adjacent bends to be made in a single bar both on and off the construction site.

10 Claims, 4 Drawing Figures

BENDING MACHINE

BACKGROUND OF THE INVENTION

1. Field of the Invention

This invention relates to a hand operated device for bending metal bars and the method of use thereof. The device is particularly adapted, although not restricted, to bending bars used to reinforce concrete, generally known as rebars. Rebars are typically made of steel or iron and after they are bent they are placed inside concrete before the concrete is poured. The device of the present invention is portable and hand operated, therefore, it may be transported readily to a construction site and used in-field without need for an external source of power.

2. Description of the Prior Art

In the past, bending of rebars was usually done away from the construction site and the pre-bent rebars were transported ready for use to the site. Under such circumstances it was necessary to predetermine the number of rebars needed at the construction site. It was also necessary to predetermine the angle to which the bars should be bent, the number of bends which should be made in each rebar and the relative locations of the bends. Usually it was not feasible or possible to bend bars on the site to accommodate needs as they arose although some such prior art devices existed. However, they required that the metal bar be threaded through holes in the devices, or into passages or the like which resolved the devices time consuming and cumbersome to use.

U.S. Pat. No. 1,054,132 to Miner discloses a portable bending machine for bending corner bars of steel. Such bars were used to protect concrete covered street curbs. The device disclosed by Miner has two stationary blocks which support an initially straight bar. A lever is depressed and a ram pushes the bar towards the stationary blocks, thereby causing the bar to curve. The bending device disclosed in the Miner patent, though portable, is not well suited for use in the environment of a construction site; its construction is too heavy therefor, it requires flat support surfaces which are typically not available at a construction site, and it is cumbersome to use, especially when making reverse bends.

Other prior art patents disclose stationary bending machines for use in a manufacturing plant. Examples of such prior art are U.S. Pat. No. 3,333,445 to Mergler, which discloses a bending system which is digitally controlled, and British Pat. No. 1,243,199 to Clement et al., which discloses a device used to bend a metal sheet.

SUMMARY OF THE INVENTION

The present invention provides a relatively light weight, conveniently used, portable device for bending metal bar, such as rebar. The device is hand operated and also portable, so that it may be placed on the ground and used at the construction site. The device includes a base which is stable and adapted to be placed on the ground. Two spaced apart posts protrude from the base. The posts have a height greater than that of the rebar to be bent. Mounted to the base is an elongated slide adapted to be linearly movable. Additionally, two spaced apart lugs are attached to the slide. The spaced apart lugs define between them a groove substantially perpendicular to the longitudinal extent of the slide. Further, the lugs have a height greater than the diameter of the bar to be bent. A linear guideway for the slide is mounted to the base. The guideway has an upwardly open, elongated slot through which the lugs attached to the slide protrude.

The guideway allows the slide to be positioned so that the lugs and the groove are disposed between the posts for linear movement past a line connecting the posts to either side of the posts. An elongated handle is pivotally attached to the base and includes a relatively short lever extending from a pivot axis for the handle toward the slide. The lever is connected to the slide so that the pivotal movement of the handle moves the slide linearly in the guideway.

A bar to be bent is inserted directly into the groove which is formed between the lugs on either side of the posts. After it is inserted into the groove, the bar is bent by pivotally moving the handle in a corresponding direction such that the bar contacts the posts.

One advantage of the present invention is that the lugs define a slot perpendicular to slide movement, such that the operator can simply drop metal bars of different diameters into a slot without having to thread the bar through holes, into passages or the like. This feature is labor saving. The slot holds the rebar securely making the device easier to use. Additionally, the slot is formed by two lugs with rounded contact surfaces for smoother bends and no surface scratches or damage to the rebar. The rebar is bent by contact with a pair of posts. Each post includes a roller with a groove which is greater than the diameter of the rebar so that the rebar is held securely thereby preventing the rebar from popping out, especially on uneven ground around a construction site. The grooved rollers also reduce friction, thereby making the work easier, and they also act as positive guides during bending of the rebar to assure the bar is bent in a plane rather than skewed.

Further, the present invention has a relatively long slide wherein the lugs and posts become double acting and allow tighter reverse bends without the need to flip over the sometimes long bars. The need to flip long bars over to bend them in a reverse direction is time consuming and expensive, and if done without care can cause injury and/or damage at the construction site. The long slide also provides good guidance for linear movement thereby insuring less likelihood of wedging and damaging the slide. This is important because the bars are subject to large forces during the bending process. The entire bending process takes place in a horizontal plane; thus, multiple, closely adjacent bends can be made. It is also possible to make one or more bends in a direction 90° to the first bend. Bends may be made within four inches of one another. In fact, with the device of the present invention a stirrup formation can be made at the construction site. A stirrup formation is made by bending the bar so that three angles of approximately 90° each are made thus arriving at an approximately square formation. Bars bent into stirrup formation are typically used to reinforce cement columns. It is also possible to form an S- or Z-bend by bending the bar at 90° angles in opposite directions.

DETAILED DESCRIPTION OF THE PREFERRED EMBODIMENT

Figure 1:
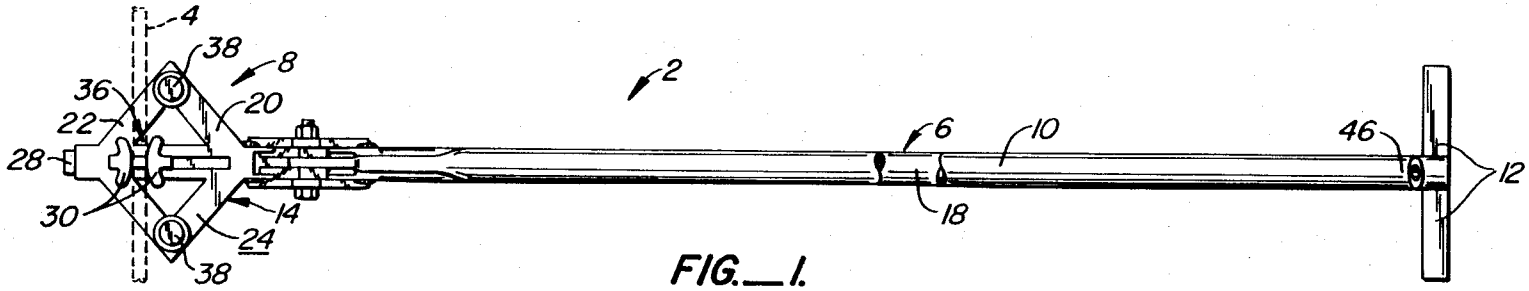
FIG. 1 is a plan view of the bending device of the present invention showing a metal bar prior to bending.

Referring to the drawings, a portable, hand-operated device 2 constructed in accordance with the present invention for bending metal bar, typically round rebar 4, comprises an elongated base 6, a bending mechanism 8 at one end of the base and an actuating handle 10 operatively coupled with the bending mechanism. To provide stability for the device the base includes generally transversely oriented cross-legs 12 at one end thereof and a transversely extending yoke 14 at the other end of the base and which forms part of the bending mechanism. To reduce the weight of the device while maintaining rigidity the base and the cross-legs are preferably constructed from steel pipe.

Yoke 14 forms one end of the base and supports and houses the bending mechanism 8. It includes a tubular center section 16, which is secured, e.g. welded to or integrally constructed with the proximate end of an elongated steel pipe 18 which forms the major portion of the base, and a pair of angularly inclined arms 20, 22 which laterally protrude from the center section to either side thereof. The free ends of the arms are joined, e.g. welded together, for strength and rigidity. The upwardly facing surfaces of the center section 16 and arms 20, 22 are flat and lie in a common plane to define a flat, horizontal support surface for the rebar to be bent by the device.

The tubular center section 16 of the yoke defines an internal, elongated, linear guideway 26 which linearly reciprocably mounts an elongated slide 28. The slide includes a pair of spaced apart lugs 30 which protrude from the slide through an elongated, upwardly open slot 32 in the tubular center section 16 of the yoke. The lugs have opposing, convexly arcuate bending surfaces 34 which define between them a groove 36 of a sufficient width so that rebar to be bent can be placed in to the groove. The height of the lugs is greater than the diameter of the largest rebar capable of being bent by the device, i.e. the height is greater than the width of groove 36.

A pair of bending posts 38 are positioned on a line perpendicular to the guideway 26 at the outward ends of arms 20, 22. Each post comprises a shaft 40 firmly secured, e.g. welded to the yoke and protruding upwardly past the flat support surface 24. A roller 42 is rotatably carried by the protruding portion of the shaft 40 and is suitably restrained to the shaft to prevent relatively axial movements of the roller. Each roller has a height greater than the diameter of the largest rebar and capable of being bent by the device and a concave peripheral surface 44 for nesting the rebar during bending.

Handle 10 is preferably an elongated section of steel pipe having a free end 46 which is proximate cross legs 12 and a second end which is pivotal about a pivot shaft 48 carried on supports 50 protruding upwardly from the base. A lever 52 fixed, e.g. welded to the second end of the handle is angularly inclined relative to and extends from the handle past the pivot shaft towards guideway 26. A link 54 has its respective ends pivotally attached to the free end of the lever and the proximate end of slide 28. The link translates pivotal movements of handle 10 and the lever 52 into correspondingly reciprocating, linear movements of the slide 28 in guideway 26.

Figure 3:
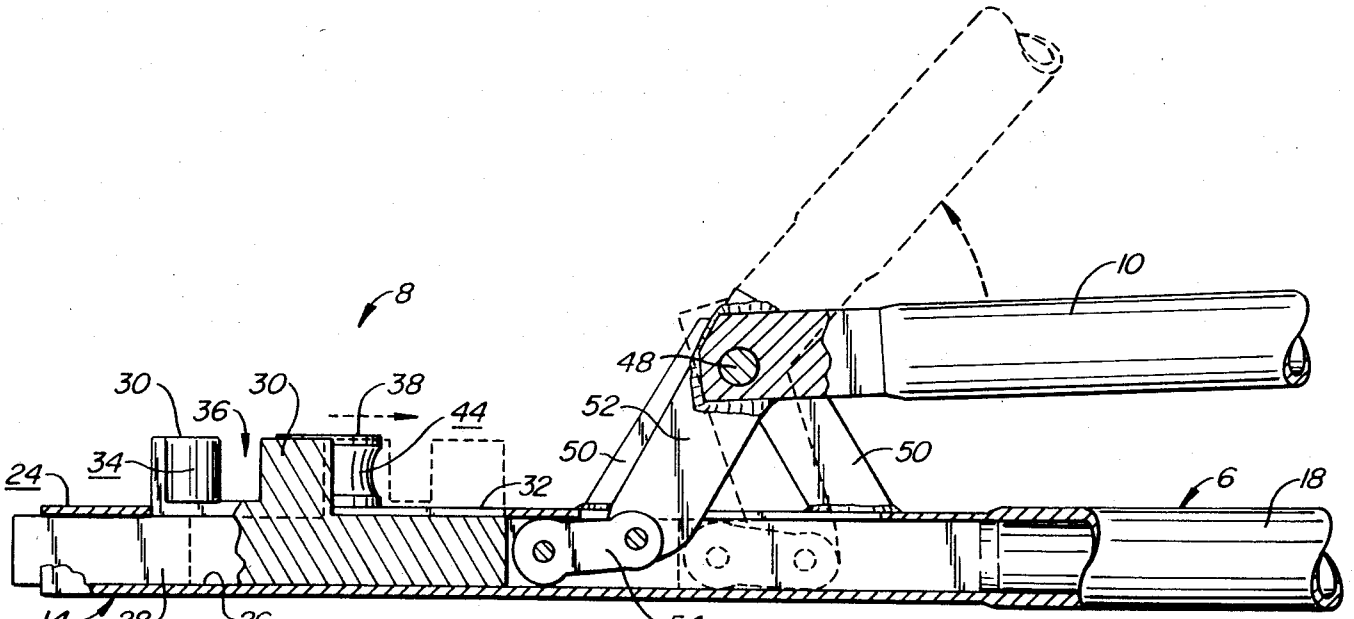
FIG. 3 is a plan view of the bending device showing a bar which has been inserted in an alternate position and which has been bent by lowering the handle.

In use the lever is fully raised, or lowered, so that groove 36 between jaws 30 is disposed on one or the other side of a straight line connecting the peripheral surfaces 44 of bending post rollers 42. As shown in FIG. 3, for example, the lever may be initially fully lowered so that the groove is to the left of the bending posts. Next, rebar 4 is placed into the groove (see FIG. 1) and the operator raises handle 10 in a counterclockwise direction, as shown in FIG. 3, until it reaches the inclined position shown in phantom lines in FIG. 3. This pivotal movement of the lever causes a corresponding linear movement of the slide within guideway 26 and, thereby, moves jaws 30 from the left hand side of post 38 to the right hand side thereof (shown in phantom lines in FIG. 3). In the course of this movement, the left hand jaw (as seen in FIGS. 1–3) applies a bending force to the rebar and, upon engagement of the rebar by the concave peripheries of rollers 42, causes the formation of a bend in the rebar as is illustrated in FIG. 2.

The application of the bending force to the rebar causes a centering of the rebar with respect to the concave profile of bending post rollers 42 even if the rebar is originally skewed relative to the posts due to an unevenness of the ground at the construction site, for example. This facilitates the operator's task of maintaining the bend(s) and the bar in planar alignment. Moreover, the convexly shaped bending surface 34 of lugs 30 assure a smooth curvature in the bent rebar and prevent the formation of nicks in its surface which could adversely affect its strength.

Figure 2:
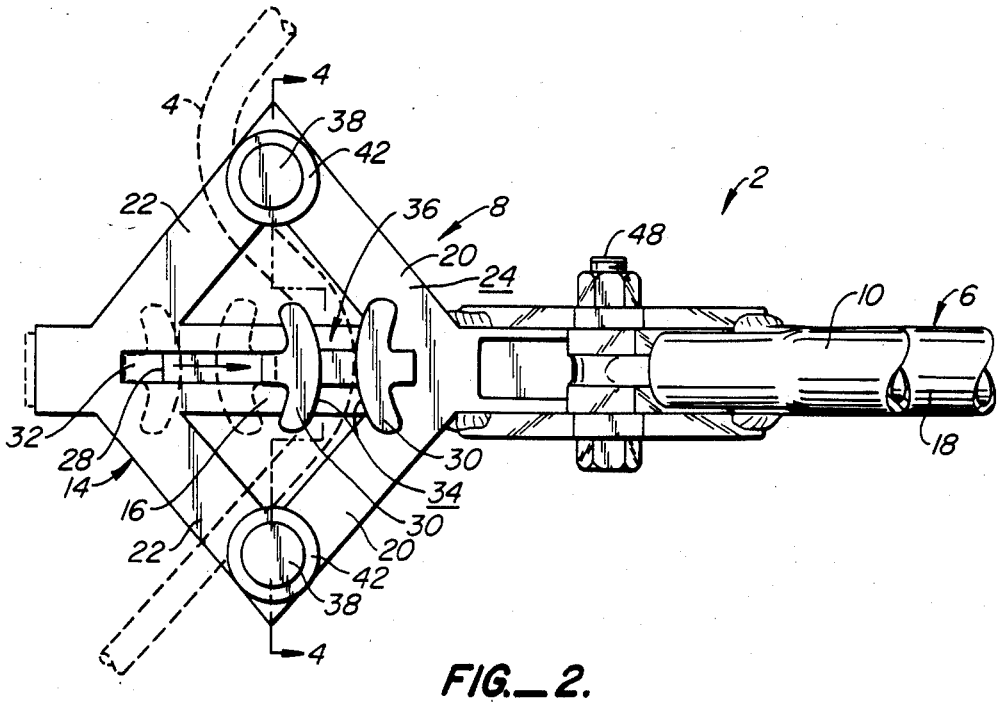
FIG. 2 is an enlarged, fragmentary plan view of the bending device of the present invention showing a bar inserted as in FIG. 1 which has been bent by raising the handle.
Figure 4:
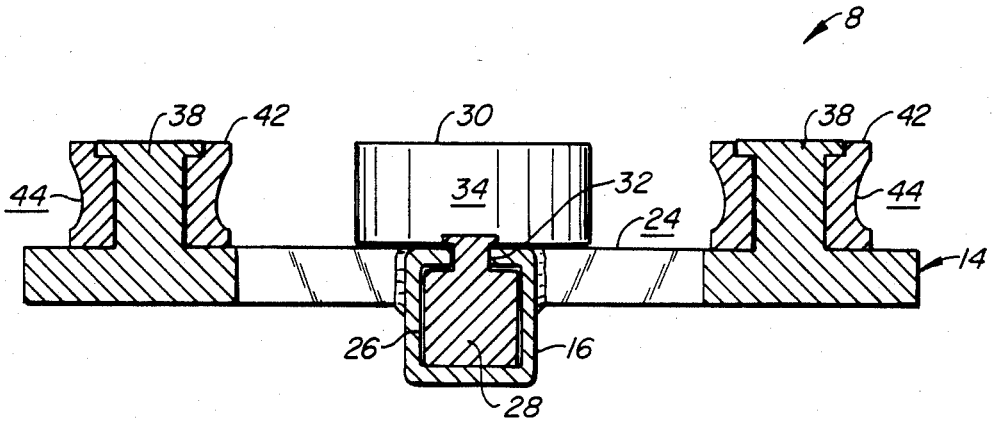
FIG. 4 is a front elevation in cross section and is taken on line 4—4 of FIG. 2.

Rebar can also be bent by placing it into groove 36 when jaws 30 are to the right of the bending posts as seen in FIG. 2, for example. In such a case, the bending operation is performed by moving handle 10 in a clockwise direction as seen in FIG. 3, from its raised position (shown in phantom lines) to its lowered position.

The rebar bending device of the present invention is particularly adapted for use in the rough environment typically surrounding construction sites. It is relatively lightweight and is readily carried by one person. Cross-legs 12 and the laterally protruding arms 20, 22 of yoke 14 assure stability of the device even placed on uneven ground. Tubular center section 16, which defines guideway 26, protects slide 26 from contact with abrasive ground, sand, etc. In addition, slide 28 is relatively long, e.g. five to ten times its width, to provide accurate guidance as it reciprocates within guideway 26 without causing wedging even when the forces applied by lugs 30 to the rebar tend to skew the slide.

What is claimed is:

1. An apparatus for the in-field bending of a rebar comprising:

an elongated base having transverse stabilizers attached to first and second ends for preventing lateral tilting of the base when placed on the ground, the base defining a tubular, linear guideway adjacent the first end and an upwardly open, elongated slot communicating with the guideway;

an elongated slide linearly reciprocably disposed within the guideway having lug means projecting through the slot and defining a groove above the slot which is oriented substantially perpendicular to the guideway and which has a depth larger than a diameter of the rebar;

first and second forming posts mounted to the stabilizer proximate the first end of the bar, the forming posts straddling the lug means and being located relative to the slot so that the lug means can be positioned on either side of the posts by correspondingly moving the slide in the guideway, the posts including roller means rotatably carried thereon, having a grooved periphery adapted to engage the rebar positioned in the groove, and having a height greater than a diameter of the rebar;

an operating handle pivotally mounted to the base at a point above the base and including a lever having a free end extending from a pivot axis of the handle towards the guideway in the base; and link means pivotally attached to the lever and the slide for translating pivotal handle motion into linear slide motion, the lever, the link means, the slide and the guideway being constructed and arranged to permit linear movement of the groove from one side of the grooved periphery of the roller means to another side thereof.

2. A hand operated device for bending a metal bar in a horizontal plane comprising:

(a) a base;

(b) guideway means at one end of said base; and an upwardly open slot communicating with the guideway;

(c) a support extending laterally from the guideway means and having a top surface being generally level with a top surface of the guideway means;

(d) first and second spaced apart vertical posts attached to the support;

(e) a slide located within the guideway and being reciprocal perpendicularly to a line connecting the posts, the guideway being defined by a tubular member, and the slide being disposed within the tubular member and having a length which is several times larger than its transverse width to provide positive guidance for the slide within the tubular member as it reciprocates therein;

(f) first and second upwardly directed lugs attached to said slide and projecting through the slot, the lugs being spaced apart so as to form a groove for accepting the metal bar for bending;

(g) an elongated handle pivotally mounted to the base; and (h) connecting means for connecting the slide to the handle for translating pivotal handle movements into linear slide movement, the connecting means including (i) a lever;

(ii) first attachment means attaching one end of the level to the handle;

(iii) a link slidable with and movable relative to the slide;

(iv) second attachment means attaching one end of the link to the slide; and (v) third attachment means attaching the link at another end to the lever.

3. The hand operated device as in claim 2 further comprising a pair of spaced apart stationary supports for pivotally mounting the handle to the base, the supports being attached to the guideway.

4. The hand operated device as in claim 2 wherein the groove is generally perpendicular to the slot in the guideway.

5. The device as in claim 2 wherein a bending surface of each lug facing the groove between the lugs has a convexly arcuate configuration.

6. The hand-operated device as in claim 2 wherein each post includes a roller and mounting means mounting the roller for rotation about an axis perpendicular to the top surface.

7. The hand-operated device as in claim 6 wherein the roller has a concavely arcuate periphery.

8. The hand-operated device as in claim 2 wherein the posts have a height greater than a diameter of the bar.

9. The hand-operated device as in claim 2 wherein the lugs have a height greater than a diameter of the bars.

10. A hand operated device for bending a metal bar in a horizontal plane comprising:

(a) a base;

(b) a tubular member defining a guideway at one end of said base and an upwardly open slot communicating with the guideway;

(c) a support extending laterally from the guideway defining member and having a top surface being generally level with a top surface of the guideway defining member;

(d) first and second spaced apart vertical posts attached to the support;

(e) a slide located within the tubular member and being reciprocal perpendicularly to a line connecting the posts, the slide having a length which is several times larger than its transverse width to provide positive guidance with the slide within the tubular member as it reciprocates therein;

(f) first and second upwardly directed lugs attached to said slide and projecting through the slot, the lugs being spaced apart so as to form a groove for accepting the metal bar for bending;

(g) an elongated handle pivotally mounted to the base; and (h) connecting means connecting the slide to the handle so that pivotal handle movements are translated into linear slide movement.

* * * * *